US010273115B2

(12) United States Patent
Hanson

(10) Patent No.: US 10,273,115 B2
(45) Date of Patent: Apr. 30, 2019

(54) DETACHABLE SPRING LOADED HEADPHONE REEL AND METHOD OF USE

(71) Applicant: Justin Hanson, Dixon, CA (US)

(72) Inventor: Justin Hanson, Dixon, CA (US)

( * ) Notice: Subject to any disclaimer, the term of this patent is extended or adjusted under 35 U.S.C. 154(b) by 425 days.

(21) Appl. No.: 15/153,720

(22) Filed: May 12, 2016

(65) Prior Publication Data

US 2016/0332842 A1 Nov. 17, 2016

Related U.S. Application Data

(60) Provisional application No. 62/160,213, filed on May 12, 2015.

(51) Int. Cl.

| | |
|---|---|
| ***H04R 1/10*** | (2006.01) |
| ***B65H 75/28*** | (2006.01) |
| ***B65H 75/40*** | (2006.01) |
| ***B65H 75/44*** | (2006.01) |

(52) U.S. Cl.

CPC ..... *B65H 75/406* (2013.01); *B65H 75/285* (2013.01); *B65H 75/4431* (2013.01); *H04R 1/1033* (2013.01); *B65H 2701/3919* (2013.01)

(58) Field of Classification Search

CPC ..... B65H 75/406; B65H 75/285; B65H 75/4431; B65H 2701/3919; H04R 1/1033

See application file for complete search history.

(56) References Cited

U.S. PATENT DOCUMENTS 2,306,611 A * 12/1942 Benjamin ..... B65H 75/42 191/12 R 5,422,957 A 6/1995 Cummins (Continued)

FOREIGN PATENT DOCUMENTS

JP 2002010385 1/2002

OTHER PUBLICATIONS

PCT ISA/KR—International Search Report in Hanson, WO2016183393, counterpart PCT application. (dated Aug. 19, 2016), 3 pages.

(Continued)

*Primary Examiner* — William A. Rivera

(74) *Attorney, Agent, or Firm* — Gordon G. Waggett, P.C.

(57) ABSTRACT

A headphone reel is disclosed comprising a base having a midpoint about an axis and opposed "L-shaped" flanges extending upwardly and then inwardly toward the midpoint. A spindle, is mounted about the axis between the base and the underside of the inwardly facing flanges. The spindle comprises a central disc segment having an outer circumference. A dial section extends from the top of the disc and has an upper section further extending between and above the flanges, the upper section having slots to receive a loop of the cable. A circumferential shoulder extends outwardly on the dial beneath the flanges. A hollow cylindrical ratchet gear is attached to the underside of the disc, with teeth on the outer surface and a spring catch on the inner surface. The ratchet rests within a semi-circular wall in the base disposed about the axis. A coilable spring connects between the base midpoint and the spring catch to provide rotational force to the spindle. Movement of the spindle, when the spring is pre-tensioned, is controlled by a pawl lever. When the pawl is released, the spring force rotates the spindle to coil the cable into the device.

5 Claims, 14 Drawing Sheets

(56) References Cited

U.S. PATENT DOCUMENTS

| | | | | |
|---|---|---|---|---|
| 5,581,821 | A * | 12/1996 | Nakano | A42B 3/166 128/866 |
| 5,762,281 | A | 6/1998 | Foley | |
| 5,867,355 | A * | 2/1999 | Arai | G11B 25/043 360/137 |
| 6,480,611 | B2 | 11/2002 | Hashimoto et al. | |
| 6,616,080 | B1 | 9/2003 | Edwards et al. | |
| 6,845,158 | B2 | 1/2005 | Koester et al. | |
| 8,774,443 | B1 | 7/2014 | Anderson et al. | |
| 8,774,446 | B2 | 7/2014 | Merenda | |
| 8,781,148 | B2 | 7/2014 | Minarik et al. | |
| 9,071,902 | B1 | 6/2015 | Ai | |
| 2002/0040945 | A1* | 4/2002 | Stepancich | B65H 75/4431 242/378.1 |
| 2004/0125977 | A1 | 7/2004 | Hong et al. | |
| 2006/0261203 | A1* | 11/2006 | Yang | B65H 75/4431 242/378.4 |
| 2009/0140093 | A1 | 6/2009 | Wu | |
| 2011/0203954 | A1* | 8/2011 | Kroupa | B65H 75/4431 206/320 |
| 2011/0284676 | A1* | 11/2011 | Taketsuna | B65H 75/4431 242/378.4 |
| 2013/0119178 | A1 | 5/2013 | Masuda | |
| 2014/0161301 | A1 | 6/2014 | Merenda | |
| 2014/0192995 | A1 | 7/2014 | Cataldo et al. | |
| 2014/0198927 | A1* | 7/2014 | Cheng | H04R 1/1033 381/74 |
| 2015/0034752 | A1 | 2/2015 | Homar | |
| 2016/0332842 | A1* | 11/2016 | Hanson | B65H 75/406 |
| 2018/0003740 | A1* | 1/2018 | Chien | B65H 75/406 |

OTHER PUBLICATIONS

PCT ISA/KR—Written Opinion in Hanson, WO2016183393, counterpart PCT application. (dated Aug. 19, 2016), 6 pages.

Skylabs miniWINDER Amazon.com product listing printed Feb. 24, 2016 (3 pages).

Recoil—Cord Winder Amazon.com product listing printed Feb. 24, 2016 (4 pages).

Totalmerchandise.co.uk—Retractable Ear Buds, prior art thought to exist over one year prior to earliest effective filed of the instant application.

Recoil—webpage from www.recoilwinders.com (2 pages)(accessed Jul. 1, 2017).

Recoil—webpage from www.recoilwinders.com "About Recoil Automative Cord Winders" (2 pages)(accessed Jul. 1, 2017).

Lowendmac—Product listing for Proporta Retractable Headphones, prior art thought to exist over one year prior to earliest effective filed of the instant application.

* cited by examiner

DETACHABLE SPRING LOADED HEADPHONE REEL AND METHOD OF USE

CROSS-REFERENCE TO RELATED APPLICATIONS

This application claims the benefit of the filing date of and priority to: U.S. Provisional Application Ser. No. 62/160,213 entitled "Detachable Spring Loaded Headphone Reel" and filed May 12, 2015, Confirmation No. 1084; said provisional application is incorporated by reference herein in its entirety for all purposes.

STATEMENT REGARDING FEDERALLY SPONSORED RESEARCH OR DEVELOPMENT

Not Applicable.

BACKGROUND OF THE INVENTION

Field of the Invention

The present invention provides a detachable spring loaded headphone reel for storing and protecting headphone cables.

Background of the Invention

Handheld devices such as mobile phones, video players, audio players, etc., have become an important part of daily life. Mobile phones, especially smart phones, are the most frequently used consumer electronics. Mobile phones are provided with a headset or headphone or earphone (also referred to as earbuds) as a necessary and standard accessory to the user(s). The earphones, earbuds or headphones typically include left and right earpieces attached to one end of an electrical cable, the electrical cable having a plug or jack on the other end. The headphone cable is typically unitary at the plug end, and then splits into two separate wires each leading to a respective left or right earpiece or earbud. The headphones are usually used for call conversations and listening to music or other audio content that are stored or streamed in the mobile phones. The headphone is usually carried separately from the mobile phone itself. For instance, carrying headphones in a bag or in the user's pocket is often a hassle, as the headphone or earbud wires generally become tangled or intertwined or sometimes become damaged. The demand for the headphones and earbuds has created a desire for protective cases to protect the wires of the headphones and earbuds against unintended tangling, breakage or damage.

Various types of conventional protective cases or reels to protect the headphones are known in the prior art. U.S. Pat. No. 5,422,957 (Cummins) describes a cable take-up for earphones. The cable take-up includes a cylindrical case and a plug mechanically attached to the case and extending axially from the case. Within the case, a cable is wound onto a rotating spool biased by a spring to retract the cable. A ratchet prevents the cable from retracting. A release in the ratchet is accessible from outside of the case. The plastic has several wires embedded therein. One end of the cable is connected to earpieces and the other end of the cable is connected to the plug through a commutator. The commutator includes a first disk having resilient, conductive contacts attached to the plug and a second, rotating disk having concentric, conductive stripes attached to the cable and rubbing on the conductive contacts.

U.S. Pat. No. 8,774,446 describes a retractable storage system for a handheld electronic device. The claimed retractable storage system comprises a removable panel with one or more storage chambers for storing an accessory item, such as a wireless earbud, cabled earbud, headphone cable or e-cigarette, and a retractable mechanism to retrieve and dispense the stored accessory item through an accessory station. The removable panel can be replaced with another removable panel configured with different structure to store a different accessory item, such as a battery to charge a wireless earbud or e-cigarette.

U.S. Pat. No. 6,480,611 describes a headphone having a cord reel. In the cited document, a housing assembly comprises an electroacoustic transducer accommodated therein and an insertion hole defined therein. A winding mechanism is accommodated in the housing assembly for winding an input cord into the housing assembly. The winding mechanism includes a cord reel biased to wind the input cord there around and an engagement member pivotally mounted in the housing assembly. When an input plug secured to one end of the input cord is inserted into the insertion hole, the input plug rotates the engagement member in a first direction, which in turn allows the cord reel to wind the input cord there around. When the input plug is removed from the insertion hole, the engagement member rotates in a second direction counter to the first direction, allowing the input cord to be drawn out of the housing assembly and preventing the cord reel from winding the input cord there around.

US Patent application publication 20040125977 describes a headphone with an automatic reeling device for a jack wire. In the cited document, the automatic reeling device comprises of two earphones, a reeling device installed inside one of the two earphones and a jack wire. The reeling device has a stationary disk, a rotating disk with a wire reel rotatable abutting the stationary disk, a coil spring mounted between the stationary disk and the rotating disk and a push button to detachably engage the rotating disk to stop its movement, or to disengage from the rotating disk to permit its movement. The jack wire is wound around the wire reel on the rotating disk. By pressing the push button, the rotating disk is released, and the coil spring provides a restitution force to rotate the rotating disk and retract the jack wire into the earphone.

The referenced patent documents use a side catch design for winding or pulling the headphones of the user(s). The use of side catch design leads to tangle, misfire and creates frustration for the user(s) to reset the device when there is slip off. The use of the reels and protective cases of the prior art do not disclose the open-faced design for winding headphones disclosed herein.

Hence, there is need for a detachable spring loaded headphone reel that has an open faced design for pulling or winding the headphone cable without causing any tangle, misfire or slip off therein.

BRIEF SUMMARY OF INVENTION

The present invention overcomes the drawbacks in the prior art and provides a detachable spring loaded headphone reel. In a preferred embodiment, the headphone reel comprises a base plate, a spindle, at-least two cover plates, a lever and a spring. The base plate with a wall includes a ring with an opening, at-least two flanges, a release arch, release slot, a pivot nub and an anchor bay. The ring is moulded inside the wall and the pivot nub is fitted at the center of the ring. The two flanges are the first flange and the second flange, wherein the two flanges are extended from the wall and placed at the either side of the wall, wherein the release arch is designed and attached to the first flange. The spindle comprises a disc with an upper end and a lower end, wherein the upper end includes a plurality of curved slots. The curved slots engage the head-phone cable during the winding operation. The curved slots are designed to create a guide for inserting the headphone cable into the device. The lower end of the disc includes a ratchet gear comprising a plurality of cog teeth oriented about the outer diameter of the gear. The lower end having the cog teeth is positioned inside the ring and thereby creating a gap between the base plate and the cog teeth to achieve better stabilization during rotational and translational movement therein, wherein the ratchet gear is fitted with a spring catch.

In the preferred embodiment, the two cover plates with a top portion and a bottom portion. The two cover plates are the first cover plate and the second cover plate, wherein the first cover plate and the second cover plate include a primary side and a secondary side. The bottom portion of the secondary side of first cover plate and the bottom portion of the secondary side of the second cover plate are extended with at-least one flange. The flanges of the two cover plates and the flanges of the base plate are conjoined together to achieve better stabilization between the two cover plates and base plate during winding or pulling operations of the headphone cable. The primary side of the first cover plate and the primary side of the second cover plate provide an appropriate horizontal stabilizing force to the lip shaped surfaced at the top of curved slots. The bottom portion of the first cover plate and the second cover plate provide a lateral stabilizing force to the dial shelf of the spindle during its operation.

The spring includes an internal bend and an external bend. The external bend is placed inside the spring catch at rear end of the spindle and internal bend is placed within the pivot nub of the base plate. The spring provides enforcing mechanism during the rotation of the spindle in clockwise and counter clockwise direction. The spindle rotation allows the head-phone cable to wrap and store around the dial. The lever includes a first end and a second end. The first end is at placed at the anchor bay and the second end is allowed to protrude towards the release slot of the base plate. The second end of the lever is engaged or pressed when the user(s) wants to wind the head-phone cable around the dial of the spindle. The second end of the lever operates to develop spring action by rotating or winding the spindle in counter-clockwise direction.

In the preferred embodiment of the invention, the primary side of the first cover plate and the second cover plate is saddle shaped, wherein the primary side of the first cover plate and the second cover plate is pressed to prevent the headphone cable from coming out of the dial and the dial shelf of the spindle.

In the preferred embodiment of the invention, the first cover plate and the second cover plate are further designed with one or more slips for storing the ear buds of the headphone after the winding operation of the headphone cable by the user(s).

In the preferred embodiment of the invention, the headphone reel is further designed to accommodate the larger cables and cords by providing the storage space therein.

In another preferred embodiment, the method includes the step of winding a spindle in counter-clockwise direction to develop tensioning effect in a spring. After winding the spindle, the headphone cable is placed into the curved slots of the spindle by the user(s). After placing the headphone cable in the curved slot, a lever is pressed to release the tensioning effect in the spring which in-turn rotates the spindle in clockwise direction. After pressing the lever, the headphone cable is wrapped and stored around the dial during the rotation of the spindle in clockwise direction. The headphone cable is pulled from the dial as and when required by the user(s). Finally, the spindle is allowed to rotate and rest at the predetermined position under the tensioning effect, once the headphone cable is pulled out.

The headphone reel is designed to create an open-faced mechanism for winding the headphone cable, which is very intuitive in its operation. The headphone reel may be further designed to accommodate larger cables and cords by providing more storage space therein. The invented headphone reel protects the headphone cable against tangle, misfire and slip off.

The present invention provides a detachable spring loaded headphone reel, which is simple, easy to use and cost effective. The invention may be used to place the headphone wire, cable or cord in a position to make it tangle free.

In another embodiment, there is disclosed a detachable spring loaded headphone reel for storing and protecting a headphone cable comprising: (a) a base member, oriented in a first plane, having an outside surface, an inside surface, an outer peripheral edge defining base left, right, front and back edges, a peripheral retaining wall extending upwardly from the inside surface along the outer peripheral edge, and a pawl lever release slot through a portion of the retaining wall proximate the left front peripheral edge; (b) a base midpoint centrally located in the inside surface of the base; (c) an axis of rotation emanating from the base midpoint substantially perpendicularly to the base first plane; (d) a cylindrical spring mounting pivot nub for securing a first, internal end of a coilable spring, the pivot nub being attached to the base inside surface and coaxially aligned with the axis of rotation; (e) a semi-circular ring wall attached to the base and centered about the axis of rotation, the ring wall having a semi-circumference defined at a first radial distance from the axis of rotation, the ring wall semi-circumference further defining an opening in the ring wall facing the left edge of the base; (f) a convex shaped camming surface extending inwardly from the left edge of the base along the base inside surface, the camming surface generally facing the ring wall opening, but ending at a distance from the ring wall to form a pawl lever gap between the camming surface and the ring wall, the pawl lever gap having a first end at the pawl lever release slot, and an opposite end defining a pawl anchor bay space between the camming surface, the ring wall and the back right edge of the retaining wall; (g) a pawl lever located within the pawl lever retaining space, the lever further comprising an enlarged first end capable of securely fitting within the pawl anchor bay, a second end extending out of the front retaining wall of the base through the pawl release slot, and a central pawl section between the first and second ends, the central pawl section further comprising a pointed member extending inwardly through the ring wall opening and capable of engaging with or disengaging from a ratchet gear, the pawl lever second end capable of urging the pawl lever to move from a first position where the pawl pointed member is engaged with a ratchet gear, to a second position where the pawl pointed member is disengaged from a ratchet gear, the camming action urging the lever towards the first, engaged position; (h) a coilable spring having a first internal end and a second external end, the spring being coaxially mounted about the axis of rotation, the first internal spring end being attached to the pivot nub; (i) opposed flange members extending upwardly from the left and right outer peripheral edges of the base to a desired flange height; (j) a spindle, rotatable about the axis between the opposed flange members, the spindle comprising: (1) a central disc section having upper and lower surfaces and an outer circumferential edge located at a second radial distance from the axis greater than the ring wall radial distance; (2) a generally cylindrical dial oriented about the axis and extending upwardly from the disc upper surface, the dial having an outer circumferential surface disposed a distance inwardly from the disc outer circumferential edge, the outer dial surface having a lower end connected to the disk and an upper end, the dial further comprising a circumferential shoulder extending radially inwardly from the outer dial surface upper end to an inner shoulder circumferential intersection, the dial further comprising an additional raised section, extending upwardly from the inner shoulder intersection and defining a raised section outer circumferential surface; (3) two adjacent slots extending into and across the raised dial section, the slots capable of receiving a headphone cable; (4) a hollow cylindrical ratchet gear member having inner and outer surfaces extending downwardly from the lower disc surface, the ratchet gear defining a circumference disposed at radial a distance from the axis that is less than the ring wall radius, the ratchet gear further comprising a plurality of teeth disposed about the outer surface of the ratchet gear member, the teeth capable of locking with the pawl point member when a rotational force about the axis is applied in a first direction to the spindle, the teeth not locking with the pawl point with a rotational force about the axis is applied in a second direction, opposite the first direction, to the spindle, the ratchet gear member inner surface further comprising a spring catch extending therefrom forming a spring catch groove for receiving the spring second external end; and (k) opposed cover plates having outer and inner ends, the outer ends being attached to the flanges, the cover plates extending radially inwardly to a distance proximate the outer circumferential surface of the dial raised section, the cover plates having upper and lower surfaces, the lower surfaces proximate the inner ends being spaced apart from the dial should to form a spindle retaining area gap, the cover plate inner ends being generally convex in shape.

Other objects and advantages of the embodiments herein will become readily apparent from the following detailed description taken in conjunction with the accompanying drawings. In the drawings, like reference numerals refer to like elements.

DETAILED DESCRIPTION OF THE INVENTION

Figure 1:
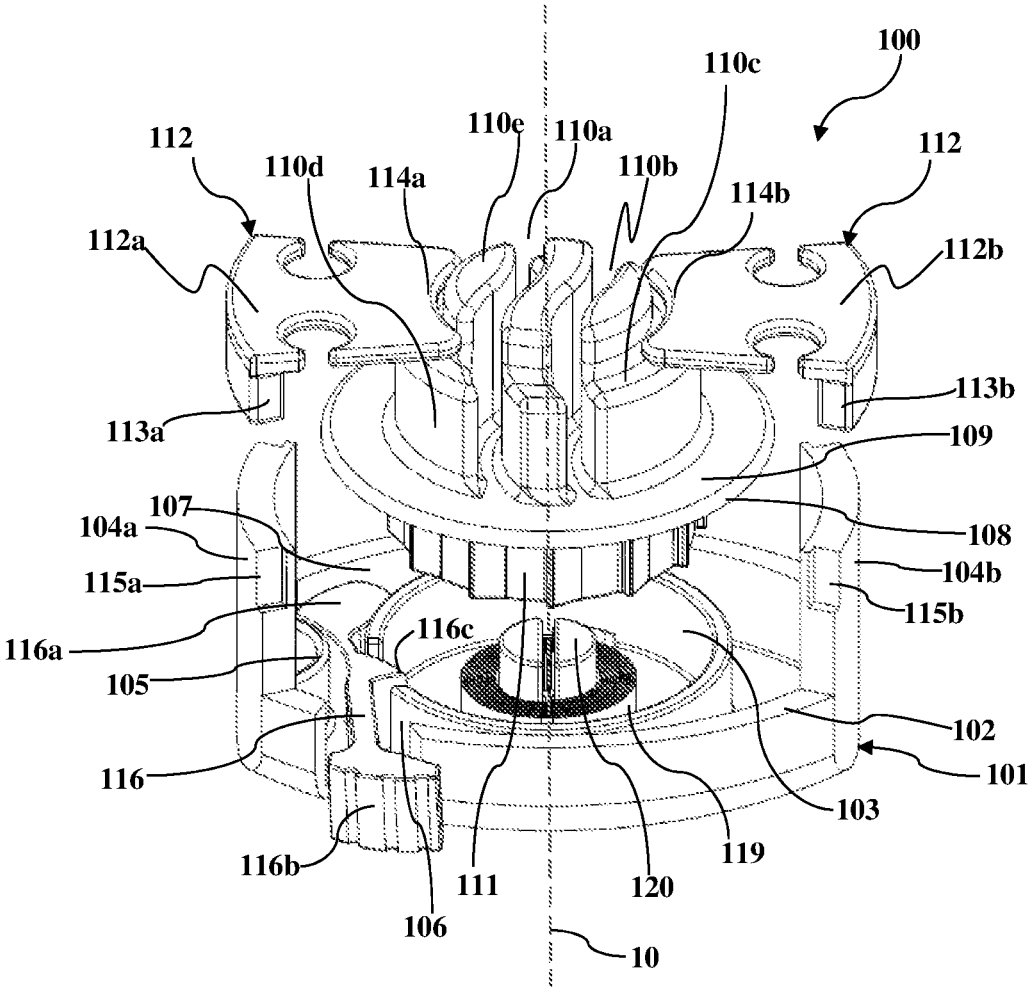
FIG. 1 illustrates a perspective exploded view of the headphone reel, according to one embodiment of the invention.

Reference will now be made in detail to the description of the present subject matter, one or more examples of which are shown in figures. Each embodiment is provided to explain the subject matter and not a limitation. These embodiments are described in sufficient detail to enable a person skilled in the art to practice the invention, and it is to be understood that other embodiments may be utilized and that logical, physical, and other changes may be made within the scope of the embodiments. The following detailed description is, therefore, not be taken as limiting the scope of the invention, but instead the invention is to be defined by the appended claims.

The present invention provides a detachable spring loaded headphone reel for storing and protecting the headphone cable against tangle, misfire and slip off. The headphone reel comprises a base plate, a spindle, at-least two cover plates, a lever and a spring. The spring provides enforcing mechanism during the rotation of the spindle in clockwise and counter clockwise direction. The spindle rotation allows the head-phone cable to wrap and store around the dial for a sufficient number of revolutions to coil up the cable. In one embodiment, the spindle rotation is capable of between about 5 to 7 complete revolutions. The ear buds of the headphone may be placed in the slips of the cover plates once the headphone cable is stored in the dial of the spindle.

In a preferred embodiment, the headphone reel (100) comprises a base plate (101), a spindle (108), at least two cover plates (112), a pawl-type lever (116) and a spring (119). The base plate (101) includes a wall (102). The base (101) further includes a ring wall (103) with an opening (103*a*), two flanges (104*a* and 104*b*), a release arch (105), release slot (106), a pivot nub (120) centered on axis (10) on the base underside (101*b*) for securing one end (119*a*) of spring (119) to the base (101), and an anchor bay (107). The two flanges are the first flange (104*a*) and the second flange (104*b*). The two flanges (104*a* and 104*b*) are extended from the wall (102) and placed on opposed sides of the wall (102). The release arch (105) is attached to the first flange (104*a*).

FIG. 1 illustrates a perspective exploded view of the headphone reel (100), according to one embodiment of the invention. As will be discussed further herein in connection with other figures, in this embodiment, the headphone reel (100) generally comprises a base section (101), a coiled spring (119) within a housing (109*e*), and a spindle (108) rotatable about an axis (10), the spindle contained by cover plates (112*a*, 112*b*) and being driven rotationally by the force from the wound spring (119). The spindle upper side (109) contains a dial section (110) for receiving spooled headphone cable (20*a*), and an underside (109*b*), connected with the spring (119). The rotational motion of the spindle (108) is governed by a ratchet (111) and pawl (116) mechanism or the like, the ratchet gear (111) being attached to the underside of the spindle (109*b*). The spindle (108) can be wound to pre-tension the spring (119), and held in its pre-tensioned state by the action of the pawl (116). Headphone cable (20*a*) can be attached to the dial (110), via slots (110*a*, 110*b*), and then wound onto the dial (110) by releasing the pawl (116) which then permits the spring (119) to rotate the spindle (108) in a first, winding direction about the axis (10). The headphone cable (20*a*) is now in a stored state within the reel device (100). When the user desires to use the headphone cable (20*a*), the user pulls the cable outwardly which causes the spindle to move in a second, unwinding direction (opposite to the first direction). As the cable (20*a*) is pulled from its storage state, the spindle spring (119) again becomes pre-tensioned and is ready for next use. As will be understood, as the cable (20*a*) is being pulled out of the storage area (30), the teeth (111*a*) on the ratchet gear (111) slide over the sloped side of the pawl engagement permitting the spindle to rotate.

In a preferred embodiment, the headphone reel (100) comprises a base plate (101) having outer surface (101*a*) and inner surface (101*b*). The reel device (100) further comprises a spring wound spindle (108), rotatable about an axis (10), further including a ratchet gear (111) capable of engaging with a pawl lever (116), at least two cover plates (112), and a tensioning spring (119).

Figure 2:
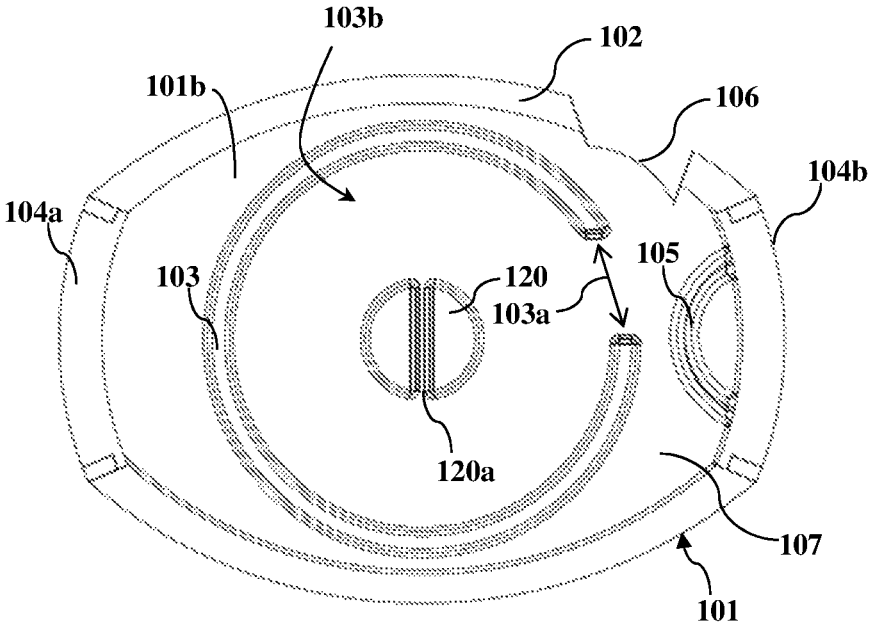
FIG. 2 illustrates an inside view of the base plate, according to one embodiment of the invention.

FIG. 2 illustrates an inside view of the base plate (101) according to one embodiment of the invention. The base plate (101) further includes an outer wall (102). The base (101) also includes a semicircular ring wall (103) disposed about the axis (10) on the inside surface (101*b*) of the base (101), the ring wall further comprising an opening (103*a*) for receiving the pawl engagement point (116*c*). The base (101) further comprises two opposed flanges (104*a* and 104*b*) extending upwardly from the wall (102), a release arch (105), release slot (106) in the wall (102) to permit the passage of the user contact end of the pawl lever (116*c*) and an anchor bay (107) for anchoring the pawl lever (116). The two flanges are the first flange (104*a*) and the second flange (104*b*). The two flanges (104*a* and 104*b*) extend outwardly from the wall (102) and are generally located opposed to each other on opposite ends of the base (101). The release arch (105) is attached to the first flange (104*a*) and interfaces with the pawl (116). A pivot nub (120) is located at the axial (10) midpoint on the base underside (101*b*) and further comprises a pivot nub slot for receiving and anchoring one end (119*a*) of spring (119).

Figure 3A:
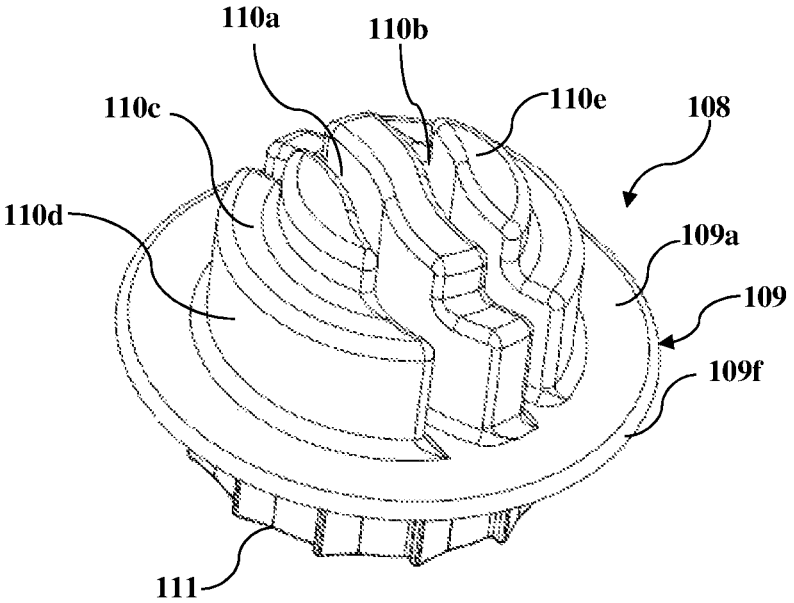
FIG. 3*a* illustrates a top perspective view of a spindle, according to one embodiment of the invention.

FIG. 3*a* illustrates a top perspective view of the spindle (108), according to one embodiment of the invention. In the preferred embodiment, the spindle (108) comprises a disc (109) with an upper end (109*a*), a lower end (109*b*) and an outer circumferential edge (1090. The upper end (109*a*) further comprises a generally cylindrical dial (110) disposed a distance inwardly about the axis (10) from the outer circumferential edge (1090 and extending upwardly a distance from the upper end (109*a*) surface. The dial (110) further comprises outer circumferential surfaces (110*d*) for receiving the spooled headphone cable (20*a*). The upper end includes two slots (110*a* and 110*b*). The two slots (110*a* and 110*b*) (shown here as parallel curved slots) engage the head-phone cable (20*a*) during the winding operation. The slots (110*a* and 110*b*) are designed to create a guide for inserting the headphone cable (20*a*) into the device (100). The dial (110) further comprises two slots (110*a* and 110*b*) each shown here essentially bisecting the dial to divide the dial into three parts. The two slots (110*a* and 110*b*), shown here as parallel curved slots, engage the headphone cable (20*a*) during the winding operation. The slots (110*a* and 110*b*) are designed to create a guide for inserting the headphone cable (20*a*) into the device (100). The slots (110*a*, 110*b*) are shown here as being curved, but other shapes, including straight slots are possible. Additionally, a U-shaped groove (not shown) could be employed in the upper section of the dial to accommodate the insertion of the cable (20*a*) in similar fashion as with the parallel slots, where each end of the "U" exists on the same the side (110*d*) of the dial in similar fashion as the slots emerge on the same side of the dial. Also, while the slots (110*a*, 110*b*) are depicted as being parallel with each other, the slots do not have to be parallel with each other.

Figure 3B:
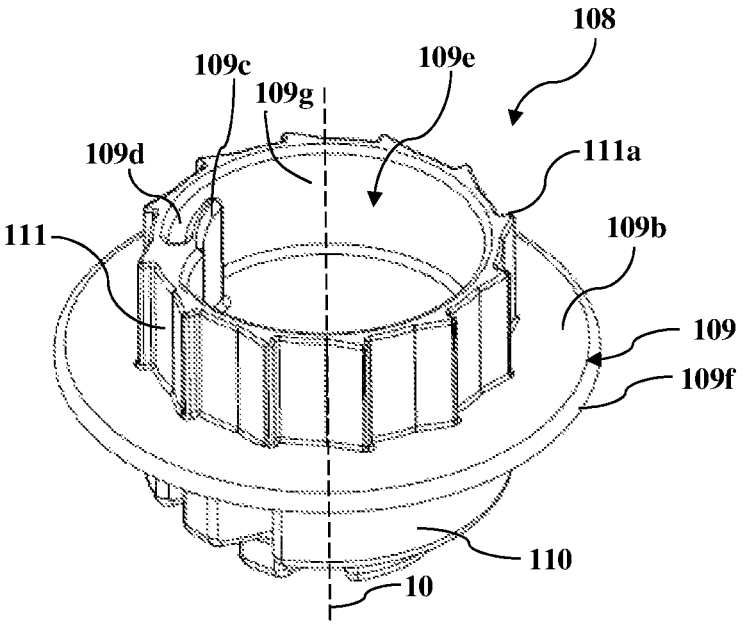
FIG. 3*b* illustrates a bottom perspective view of FIG. 3*a*.

FIG. 3*b* illustrates a bottom perspective view of the spindle, according to one embodiment of the invention. The lower end of the disc includes a plurality of cog teeth (111*a*) in a circular manner. The lower end (109*b*) having the cog teeth (111*a*) is positioned inside the ring (103) and thereby creating a gap between the base plate (101) and the cog teeth (111*a*) to achieve better stabilization during rotational and translational movement therein.

In a preferred embodiment, the spindle (108) comprises a disc (109) with an upper end (109*a*), a lower end (109*b*) and an outer circumferential edge (1090. The upper end (109*a*) further comprises a generally cylindrical dial (110) disposed a distance inwardly about the axis (10) from the outer circumferential edge (1090 and extending upwardly a distance from the disc upper end (109*a*) surface. The dial (110) further comprises outer circumferential surfaces (110*d*) for receiving the spooled headphone cable (20*a*).

The dial (110) further comprises a dial shelf or shoulder (110*c*) at its top outer circumference leaving the remaining upper portion of the dial to form lip shaped surfaces (110*e*) that extend upwardly. As will be seen in connection with the other figures, the plate covers (112) attach to the base flanges (104*a*, 104*b*) and have as one function, the creation of a semi-enclosed internal space (30) to permit housing of the coiled or spooled cable (20*a*). Another function of the cover plates is to provide an upper boundary to retain the spindle, such that, as the spindle moves about the axis (30), the spindle will have some room to move upward, but the covers (112*a*, 112*b*) will retain the spool (108) within the reel device (100) via interaction with the dial shoulder or shelf (110*c*). The opposed plate covers do not extend around the entire circumference of the spindle (108) so as to permit top loading of the cable (20*a*) into the slots. Once the cable is loaded into the slots, the headphone cable (20*a*) is wound around the dial and stored within semi-enclosed space (30).

The lower end of the disc (109) includes a ratchet gear (111) comprising a plurality of cog or ratchet teeth (111*a*) disposed about the circumference of the gear (111), the gear (111) being attached to the underside (109*b*) of the spindle (108), and extending downwardly, the gear also being disposed inwardly from the disc outer circumferential edge (109*f*) to permit the ratchet gear outer circumference to fit within the ratchet gear receiving area (103*b*) within the ring wall (103). The lower end (109*b*) having the cog teeth (111*a*) is positioned inside the ring (103) thereby creating a gap between the base plate ring wall (103) and the cog teeth (111*a*) to achieve better stabilization during rotational and translational movement therein. The ratchet gear (111) is a generally hollow cylindrical shape extending downwardly from the spindle underside (109*b*), the gear teeth (111*a*) being located on the outer surface of the cylinder. The inner surface (109*g*) of the gear cylinder forms the housing area (109*e*) for the spring 119. The inner gear cylinder surface (109*g*) further comprises a spring catch (109*c*) extending therefrom forming a spring catch groove (109*d*) for receiving one end (119*b*) of the spring (119). The other end (119*a*) of the spring attaches within the pivot nub slot (120*a*) of the pivot nub (120) located at the axial (10) midpoint on the base underside (101*b*).

Figure 4A:
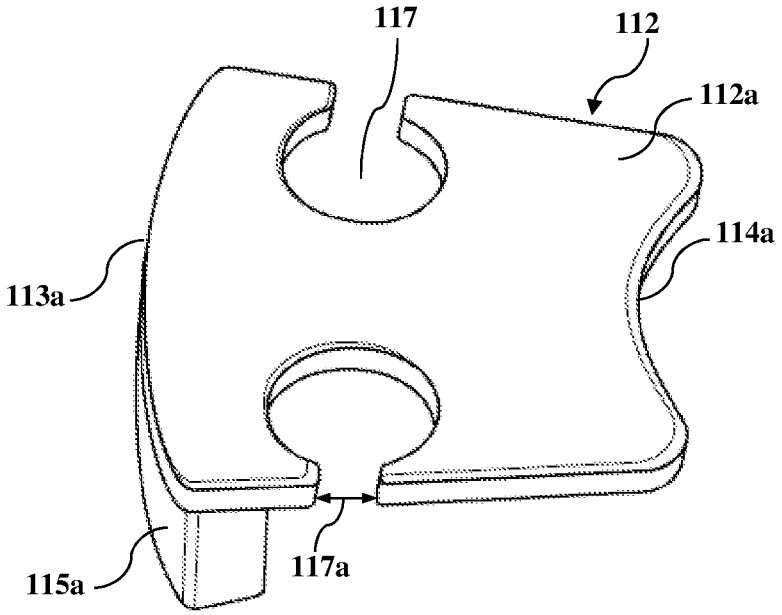
FIG. 4*a* illustrates a top perspective view of a cover plate, illustrating optional slips, according to one embodiment of the invention.

FIG. 4*a* illustrates a top perspective view of an exemplary cover plate (112), according to one embodiment of the invention. In a preferred embodiment, the two cover plate top surfaces (112*a*, 112*b*) are designed with slips or openings (117, 117*a*) for storing the ear buds (20*b*) of the headphone after the winding operation of the headphones by a user. Each slip (117) has a suitable slip opening (117*a*). The primary sides (114*a*, 114*b*) of the cover plates (112) provide an appropriate horizontal stabilizing force to the lip shaped surfaces (110*e*) at top of slots (110*a* and 110*b*). The primary sides (114*a* and 114*b*) of the cover plates (112) is saddle shaped, to provide a semi-circular opening between the opposed cover plates to permit the upwardly extending lips (110*e*) of the dial (110) to rotate freely while also providing horizontal stability to the spindle (108) when the spindle is rotating. The primary sides (114*a* and 114*b*) of the cover plates (112) also serve to prevent headphone cable (20*a*) from coming off of the dial (110*d*) and the dial shelf (110*c*) of the spindle (108).

Figure 4B:
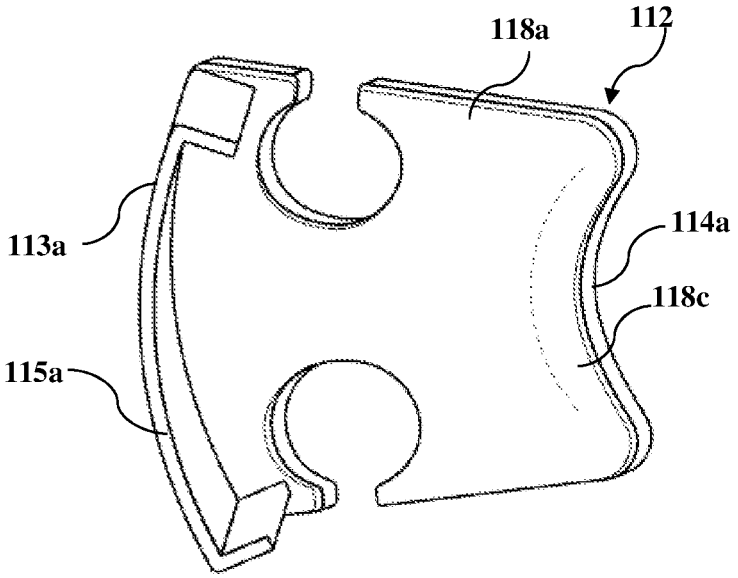
FIG. 4*b* illustrates a bottom perspective view of FIG. 4*a*.

FIG. 4*b* illustrates the bottom perspective view of a cover plate (112), according to one embodiment of the invention. In a preferred embodiment, the bottom portions (118*a* and 118*b*) of the two cover plates (112) are designed such that the bottom portions (118*a*, 118*b*) of the secondary side (113*a*, 113*b*) of the cover plates (112) are extended with a flange (115*a* and 115*b*). The flanges (115*a* and 115*b*) of the two cover plates (112) and the flanges (104*a* and 104*b*) of the base plate (101) are conjoined together to achieve better stabilization between the two cover plates (112) and base plate (101) during a winding or pulling operation of the headphone cable (20*a*). The bottom portions (118*a*) of the cover plates (112) provide a lateral stabilizing force and retaining force to the dial shelf (110*c*) of the spindle (108) in spindle retaining area (118*c*) during its operation.

Figure 4C:
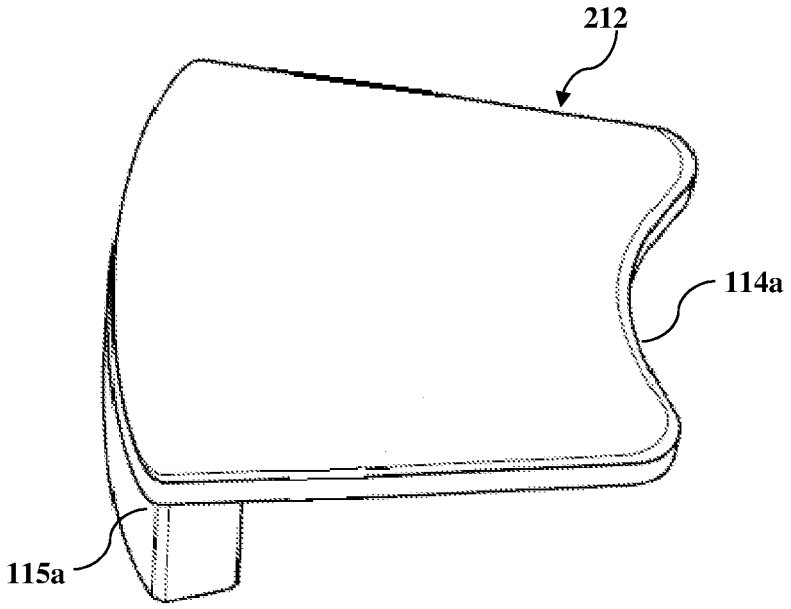
FIG. 4*c* illustrates a top perspective view of the cover plate, shown without optional slips, according to one embodiment of the invention.
Figure 4D:
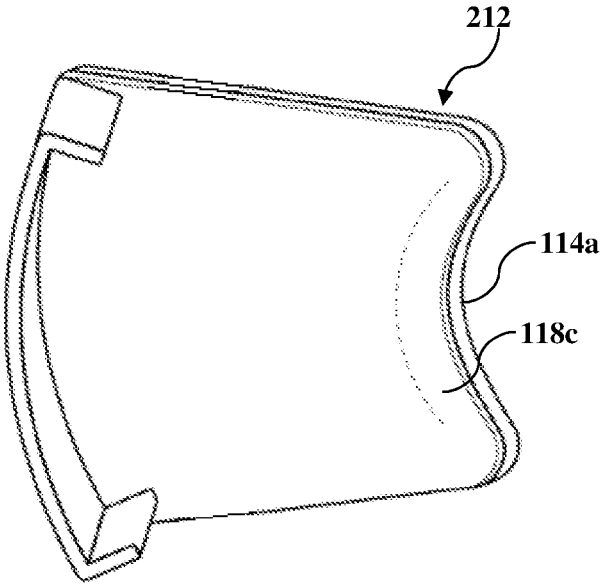
FIG. 4*d* illustrates a bottom perspective view of FIG. 4*c*.

FIGS. 4*c* and 4*d* depict cover plates (212) similar to those cover plates (112) in FIGS. 4*a* and 4*b* except without employing slips.

The two cover plates (112) include top portions (112*a* and 112*b*) and bottom portions (118*a*, 118*b*). The cover plates (112) comprise primary sides (114*a* and 114*b*) and secondary sides (113*a* and 113*b*). The bottom portion (118*a*) of the secondary side (113*a*) and the bottom portion (118*b*) of the secondary side (113*b*) of the cover plates (112) are extended with flanges (115*a* and 115*b*). The flanges (115*a* and 115*b*) of the two cover plates (112) and the flanges (104*a* and 104*b*) of the base plate (101) are conjoined together to achieve better stabilization between the two cover plates (112) and base plate (101) during winding or pulling operation of the headphone cable (20*a*).

The primary sides (114*a*, 114*b*) of the cover plates (112) provide an appropriate horizontal stabilizing force to the lip shaped surfaces (110*e*) at the top of slots (110*a* and 110*b*). The bottom portions (118*a*, 118*b*) of the cover plates (112) provide lateral stabilizing force and retaining force to the dial shelf or shoulder (110*c*) of the spindle (108) in spindle retaining area (118*c*) during its operation by retaining the upward movement of the dial shelf (110*c*) within the spindle retention gap (118*d*). The cover plates (112) serve to prevent the headphone cable (20*a*) from slipping off of the dial (110) of the spindle (108).

Figure 5A:
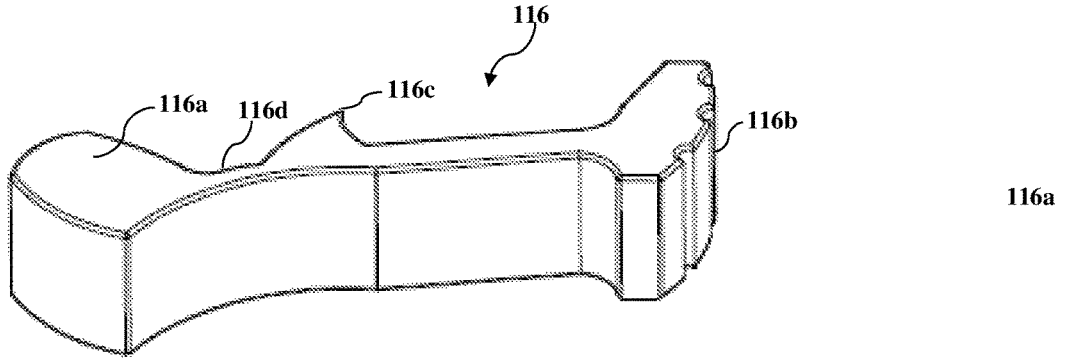
FIG. 5*a* illustrates a perspective view of a pawl style lever, according to one embodiment of the invention.
Figure 5B:
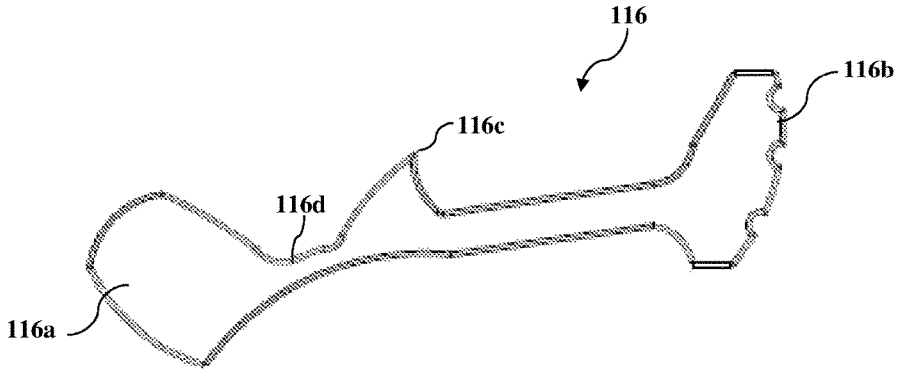
FIG. 5*b* illustrates a top plan view of FIG. 5*a*.

Referring to FIGS. 5*a* and 5*b*, in a preferred embodiment, the lever (116) includes a first end (116*a*) and a second end (116*b*). The first end (116*a*) is at placed at the anchor bay (107) and the second end (116*b*) is allowed to extend through the release slot (106) of the base plate (101). The second end (116*b*) of the lever (116) is engaged or pressed when a user wants to wind a headphone cable (20*a*) that has been placed into the slots (110*a* and 110*b*). The second end (116*b*) of the lever (116) operates to move the pawl engagement point (116*c*) out of engagement with the teeth (111*a*) of the ratchet gear (111) to release the pre-tensioning force in the spring and cause rotation of the spindle (108) in the first (winding) direction for a desired number of complete revolutions, e.g., 5 to 7 (or "several") complete revolutions.

In a preferred embodiment, the pawl lever (116) includes a first pivot end (116*a*) and a second end (116*b*) that a user can press, e.g., with the user's thumb or finger. The second end (116*b*) may comprise a smooth surface, or a surface comprising surface features, such as ridges or grooves (as shown) or other gripping material. The pawl first end (116*a*) is at placed at the anchor bay (107) and the pawl second end (116*b*) is allowed to protrude towards the release slot (106) of the base plate (101). The second end (116*b*) of the pawl lever (116) is engaged or pressed when the user(s) desires to wind the head-phone cable around the dial (110*d*) of the spindle (108). The pawl lever (116) also comprises a pawl engagement point (116*c*) for engaging with or disengaging from the ratchet gear (111) and a flex point (116*d*) to permit the inward and outward movement of the engagement point (116*d*).

Figure 6A:
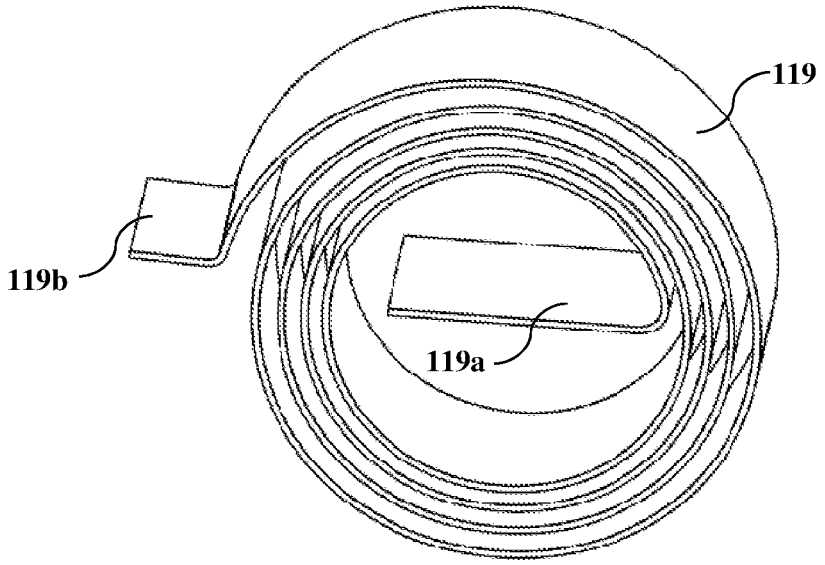
FIG. 6*a* illustrates a perspective view of the spring, according to one embodiment of the invention.
Figure 6B:
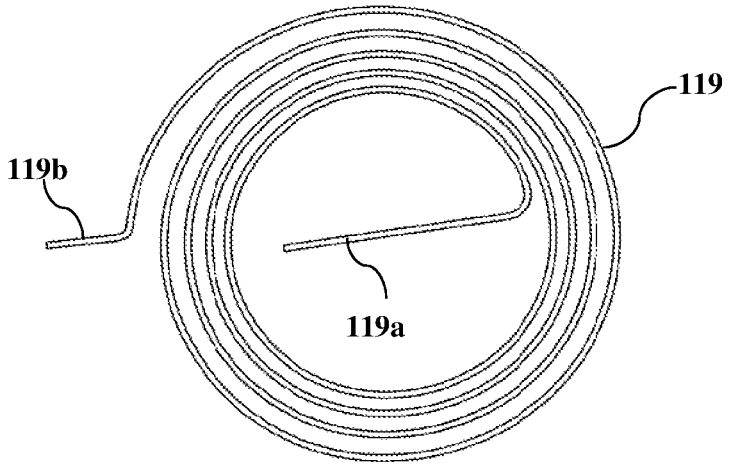
FIG. 6*b* illustrates a side plan view of FIG. 6*a*.

Referring now to FIGS. 6*a* and 6*b*, there is depicted an exemplary spring (119). In a preferred embodiment, the spring (119) includes an internal bend or internal end segment (119*a*) and an external bend or external end segment (119*b*). The external bend (119*b*) is placed inside the spring catch groove (109*d*) of the spindle (109) and internal bend (119*a*) is placed within the pivot nub slot (120*a*) located on the base inner surface (101*b*). The spring (119), when pre-tensioned via rotation, provides the rotational force to rotate the spindle (108) to in turn spool up the headphone cable (20*a*). The spindle (108) rotation allows the headphone cable (10*a*) to wrap and store around the dial (110*d*).

Figure 7:
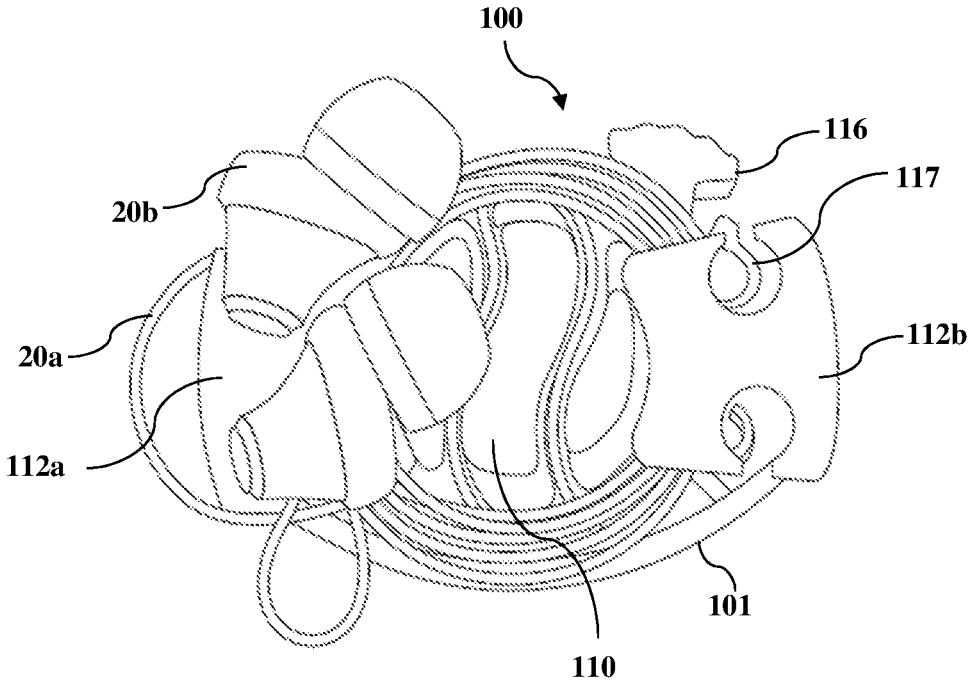
FIG. 7 illustrates a top plan view of the headphone reel shown with the headphone cable coiled on the spindle and the cable ear buds stored in the slips of one of the two cover plates, according to one embodiment of the invention.

FIG. 7 illustrates the headphone reel (100) with a headphone cable (20*a*) wound up around the spool and stored in the cable winding space (30), with the headphone cable's ear buds placed into the slips (117) of one of the two cover plates (112), according to one embodiment of the invention. In this figure, earbuds are depicted occupying the two slips (117) located on cover plate face (112*a*). This is to illustrate that once the cable (20*a*) is wound about dial outer surface (110*d*), both earbuds could be placed in separate slips (117) if desired. The slips are an optional feature depicted on cover plates (112*a*, 112*b*) and are not required. Cover plates could also be used that do not contain slips, such as the cover plates (212) illustrated in FIGS. 4*c*, 4*d* and 10*b*. In a preferred embodiment, the headphone cable is wrapped around the dial (110*d*) by the rotation of the spindle (108) in a first direction to spool the cable onto the dial (110*d*) and unwrapped by pulling the cable to cause the spindle to rotation in a second, opposite direction for a desired number of rotations, e.g., 5 to 7 (or several) complete revolutions. The earbuds (20*b*) of the headphone may be placed in the slips (117) of either of the two cover plates (112) once the headphone cable is stored in on dial outer surface (110*d*) of the spindle (108).

Figure 8:
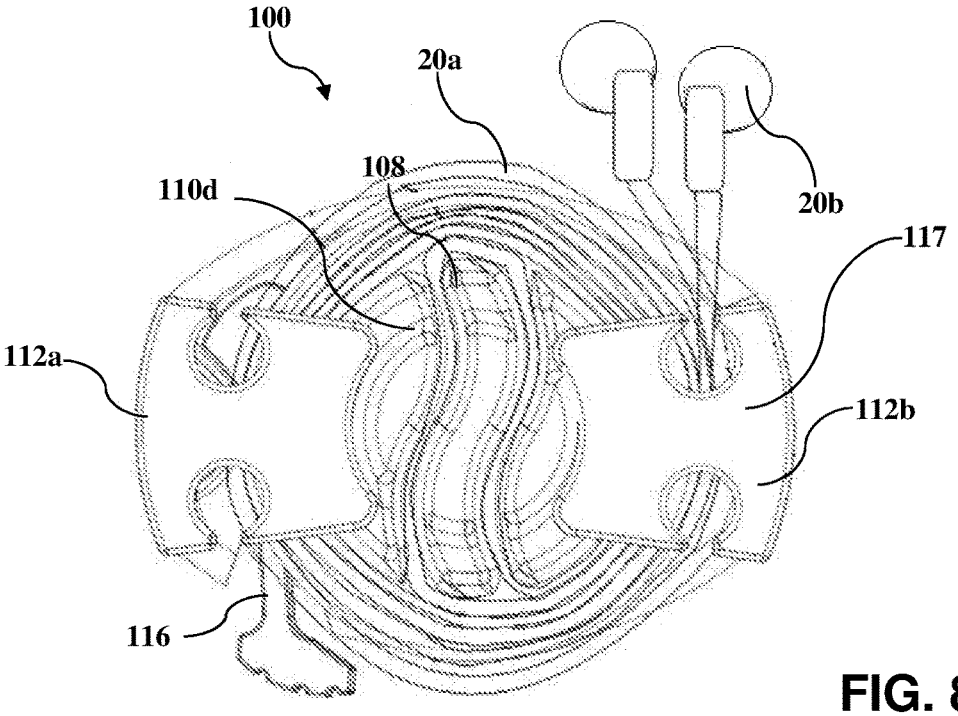
FIG. 8 shows a top view of the headphone reel with the headphone cable coiled on the spindle and the ear buds removed from the slips of the cover plates, according to one embodiment of the invention.

FIG. 8 illustrates the headphone reel (100) with the headphone cable's earbuds (20*b*) removed from the slips (117) of the cover plates (112). This illustrates that the earbuds do not have to be stored in the slips (117). This also illustrates where, e.g., the earbuds are free from the slips either just after winding or just before unwinding.

Figure 9:
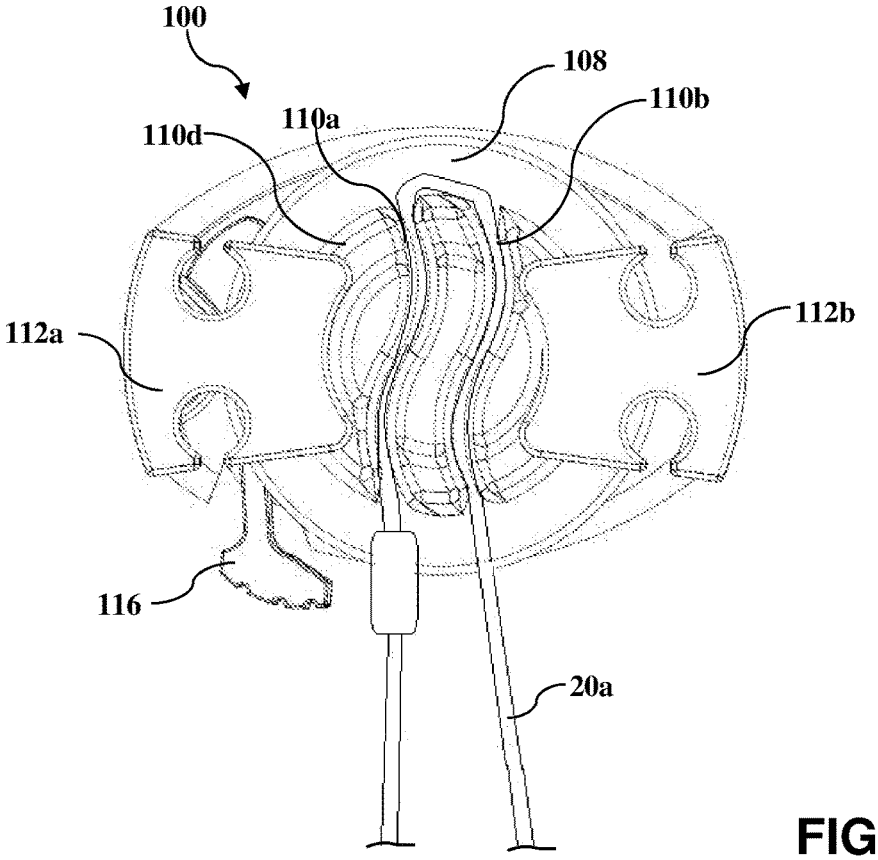
FIG. 9 shows a top view of the headphone reel with the headphone cable placed in the slots of the spindle, just prior to winding, or just after unwinding, according to one embodiment of the invention.

FIG. 9 illustrates placement of the headphone cable (20*a*) in the slots (110*a*, 110*b*) of the spindle (108). This illustrates either the positioning of the cable just prior to pressing the lever second end (116*b*) to start the spooling rotation to store the headphones, or the positioning of the cable just after pulling the cable out from its spooled, stored position just prior to next use of the headphones.

As thus constructed, cable (20*a*) is subjected to a continuous tension by spring (119). A ratchet and pawl mechanism in permits cable (20*a*) to be withdrawn to a desired length and go slack. Ratchet gear (111) is fixably attached to spindle (108). The periphery of gear (111) is serrated or toothed for engaging a pawl as illustrated in FIGS. 1, 2, 5*a*, and 5*b*. In FIG. 1, base 101 includes anchor bay (107) and opening (103). Pawl lever (116) is located with its first end (116*a*) housed within anchor bay (107). Pawl engagement point (116*c*) extends inwardly through opening (103) to permit the desired engagement with or disengagement from the ratchet gear teeth (111*a*). Pawl (116) is biased toward the ratchet gears (111) by the spring action of pawl lever flex point (116*d*) for engaging a tooth on gear (111), such as tooth (111*a*). Pawl engagement end (116*b*) extends through base 101 via release slot (106). Pressing on the pawl engagement end (116*b*) in the direction away from center axis (10) releases the engagement of the pawl with the gear teeth to permit any spring pre-tensioning to rotate the spindle (108) about axis (10). Releasing the engagement end (116*b*) or otherwise moving it back toward the center axis (10) will reengage the pawl engagement point with the gear teeth to stop rotational movement of the spindle (108).

The ratchet and pawl mechanism, coupled with the action of spring provides a one-way restriction on the motion of cable (20*a*), enabling cable (20*a*) to be withdrawn from base (101) but preventing cable (20*a*) from being retracted into base except upon manual disengagement of the pawl engagement point from the ratchet gear by pressing on the pawl engagement end (116*b*). Other mechanisms for controlling cable (20*a*) could be used instead, such as a cam or friction brake engaging cable (20*a*).

Figure 10A:
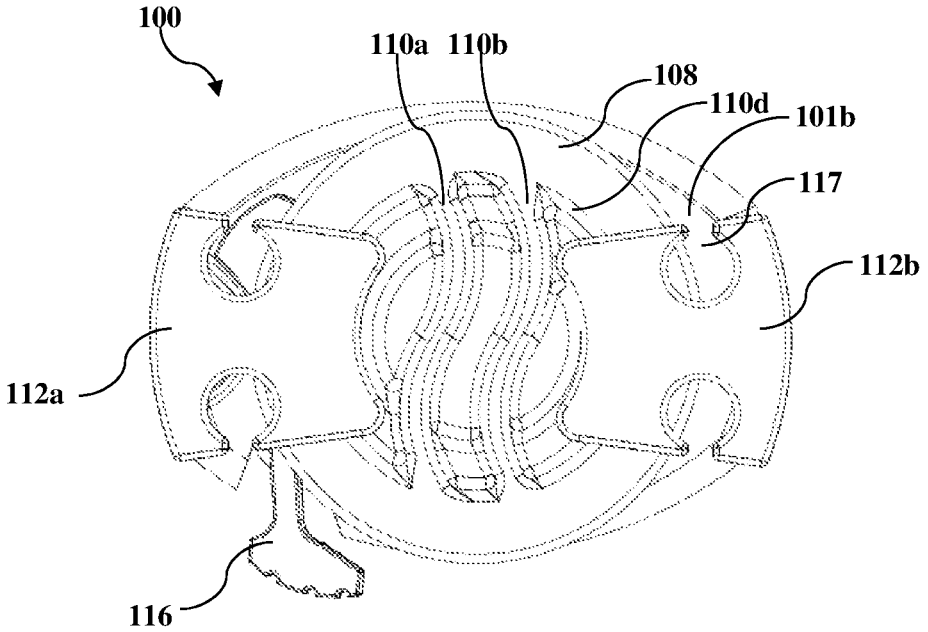
FIG. 10*a* shows a top plan view of a headphone reel, employing slips, according to one embodiment of the invention.

FIG. 10*a* shows the top view of the headphone reel (100) employing slips (117), according to one embodiment of the invention. In a preferred embodiment, the headphone reel includes the spindle (108), the curved slots (110*a* and 110*b*), dial (110*d*), the slips (117) and the two cover plates (112).

Figure 10B:
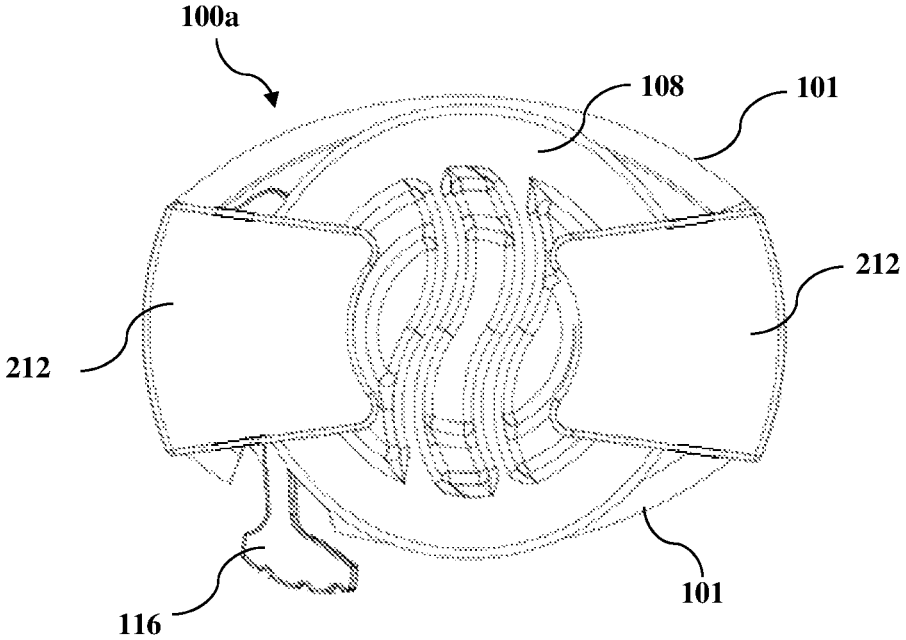
FIG. 10*b* shows a top plan view of a headphone reel, not employing slips, according to one embodiment of the invention.
Figure 11:
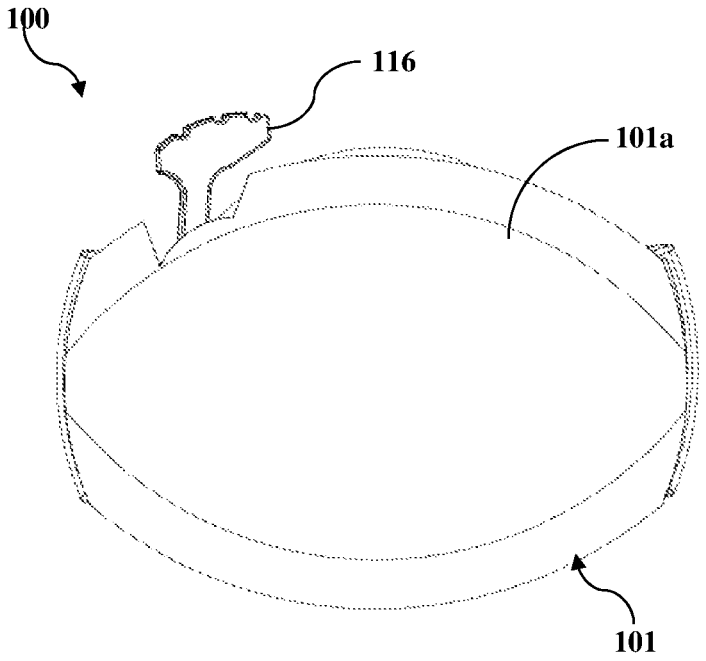
FIG. 11 shows a bottom plan view of the headphone reel, according to one embodiment of the invention.
Figure 12:
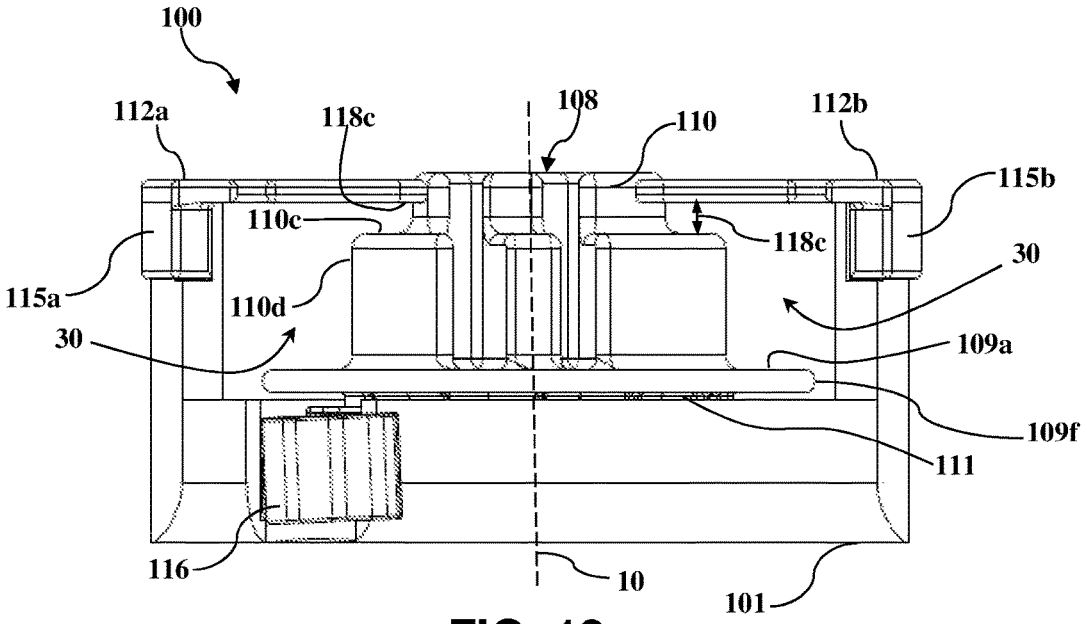
FIG. 12 shows a front plan view of the headphone reel with the lever, according to one embodiment of the invention.
Figure 13:
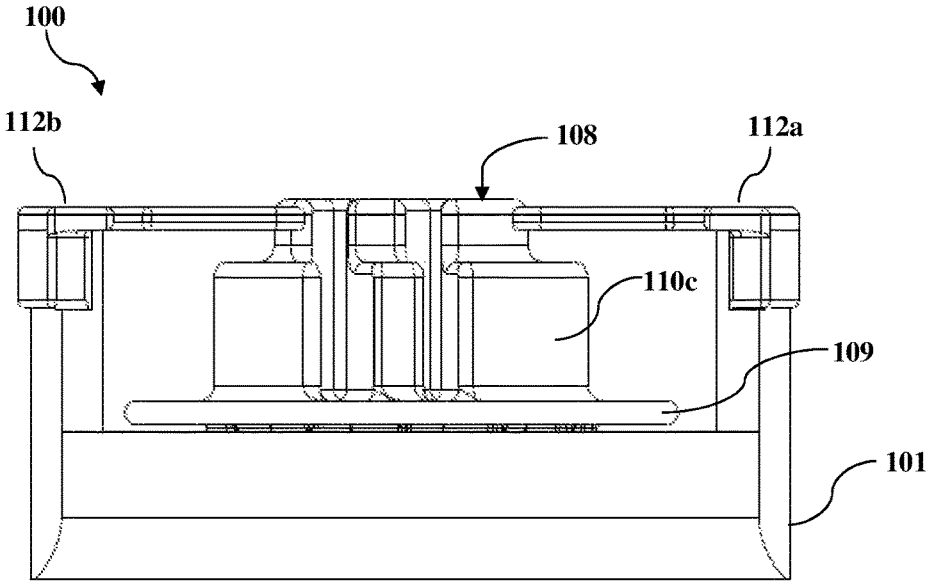
FIG. 13 shows a rear plan view of the headphone reel, according to one embodiment of the invention.
Figure 14:
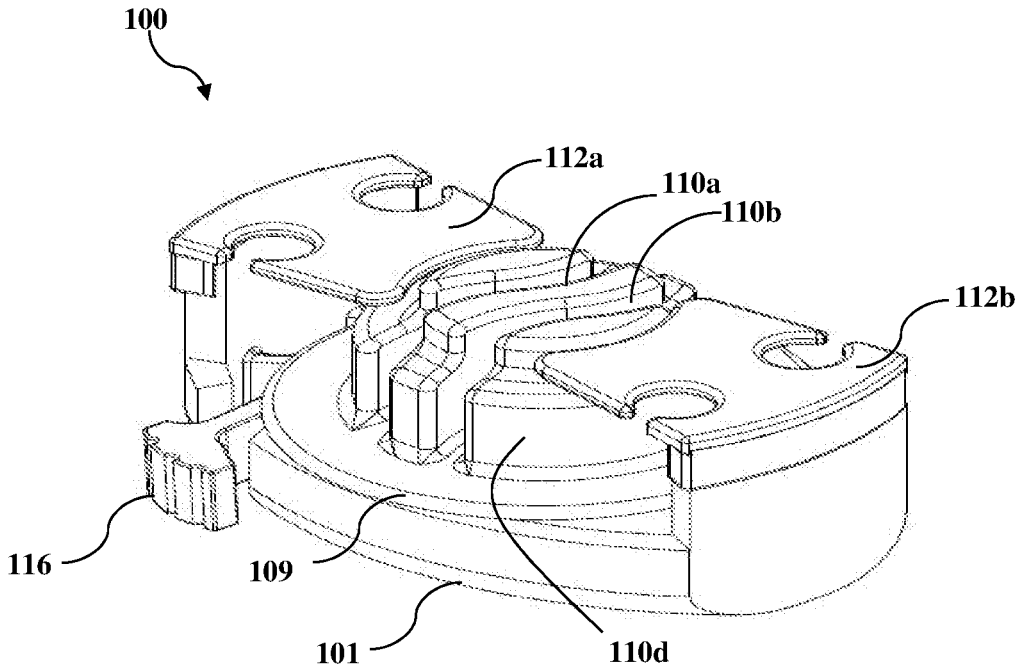
FIG. 14 shows a front right side perspective view of the headphone reel, according to one embodiment of the invention.
Figure 15:
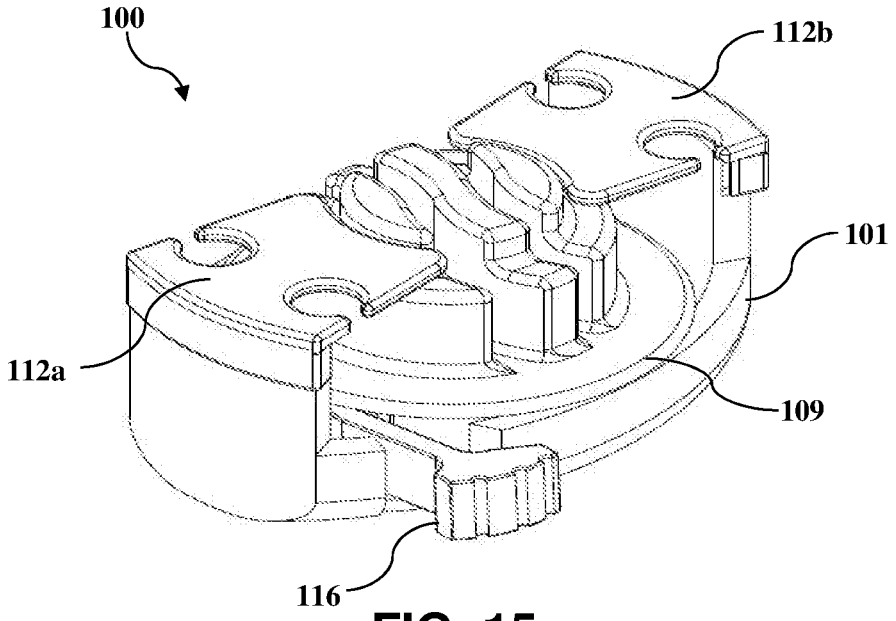
FIG. 15 shows a front left side view of the headphone reel, according to one embodiment of the invention.

As depicted in FIG. 10*b*, another embodiment of the headphone reel (100*a*) is depicted without slips being employed in the cover plates (212). Although not depicted in every view, the embodiments depicted in the figures could employ cover plates, such as those shown in FIGS. 4*c*, 4*d* and 10*b*, which do not comprise slips.

FIGS. 10*a*, and 11-14 depict several views of an exemplary headphone reel (100) employing slips (117) on the cover plate top surfaces (112*a*, 112*b*).

Figure 16:
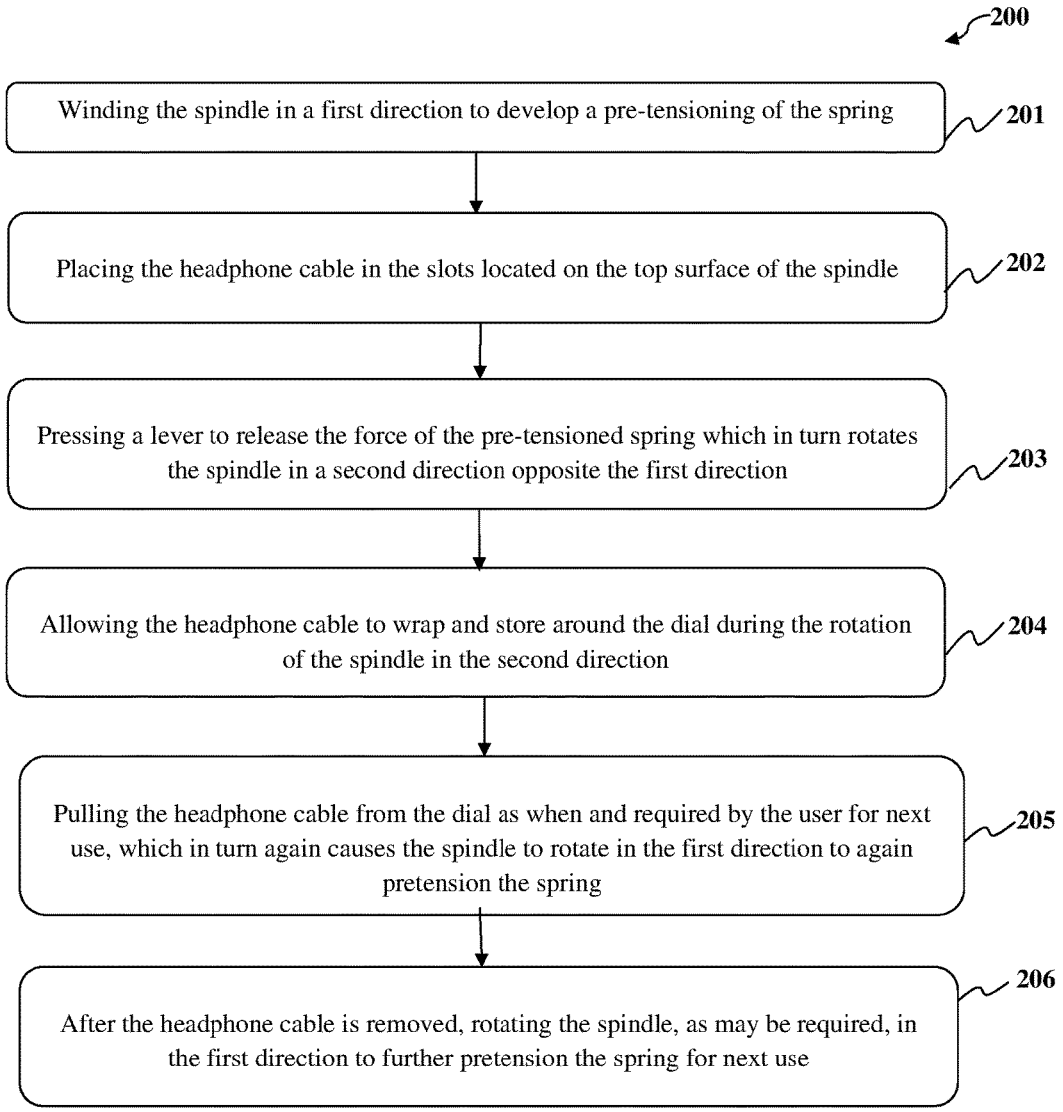
FIG. 16 illustrates the method involved in operating the headphone reel, according to one embodiment of the invention.

FIG. 16 illustrates the method involved in operating the headphone reel (100), according to one embodiment of the invention. In a preferred embodiment, the method (200) includes the steps of winding a spindle (108) on the reel device (100) in first direction to develop tensioning effect in a spring—i.e., to pre-tension the spring (119) contained in the device (100). The pre-tensioning force is maintained by the action of a ratchet pawl mechanism. After winding the spindle (108), at step (202), the headphone cable (10*a*) is placed into the slots (110*a*, 110*b*) by taking a loop of the cable and inserting the loop into the slots of the spindle (108) as generally depicted in FIG. 9. After placing the headphone cable (20*a*) in the slots (110*a*, 110*b*), at step (203), a lever (116) is pressed to release the tensioning effect in the spring (119) (by releasing the pawl engagement point (116*c*) from engagement with the ratchet teeth (111*a*) which in turn causes rotation of the spindle in a second direction. After pressing the lever, at step (204), the headphone cable (20*a*) is pulled into the device by such rotation and wrapped and stored around the dial (110*d*) during the rotation of the spindle in the second direction. At this stage, the earbuds may be placed into slips (117), if desired, if slips are employed on the cover plate top surfaces (112*a*, 112*b*). At this stage, the headphone cable is stored within the cable winding space (30) until next desired use. At step (205), at the next desired use of the headphones, the headphone cable is pulled from the dial as when and required by the user. Doing so causes the spindle to again rotate in the first direction to again place pre-tensioning force on the spring. The cable is then removed from the device (100) for use by the user. Finally, at step (206), if necessary, the spindle is again manually rotated in the first direction to complete the pre-tensioning of the spring.

The headphone reel (100) of the present disclosure is designed to create an open-faced mechanism for top loading of the cable onto the winding spool (spindle) for ease in winding the headphone cable, which is very intuitive in its operation. The headphone reel may be further designed to accommodate larger cables and cords by providing more storage space therein. The headphone reel (100) of the present disclosure protects the headphone cable against tangle, misfire and slip off.

The present disclosure provides a spring loaded headphone reel (100), which permits removable attachment and detachment of the headphone cable from the reel, and is simple, easy to use and cost effective. The headphone reel (100) may be used to place the headphone wire, cable or cord in a position such that it is tangle free.

It is to be understood, however, that even though several characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

All references referred to herein are incorporated herein by reference. While the apparatus, systems and methods of this invention have been described in terms of preferred or illustrative embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art.

I claim:

1. A spring loaded headphone reel, capable of receiving removably receiving and storing a headphone, with its cables, comprising:

a. a base plate with an outer wall comprising:
   i. a ring disposed about a central vertical axis, the ring having an opening,
   ii. at least two flanges,
   iii. a release arch,
   iv. release slot in the outer wall,
   v. a pivot nub having a slot therein for receiving an inside end of a coilable tensioning spring, and
   vi. an anchor bay for securing a lever,
   wherein the ring is moulded inside the wall and the pivot nub is fitted at the centre of the ring, wherein the two flanges are a first flange and a second flange, wherein the two flanges extend upwardly from the wall and are located on opposed sides of the wall, wherein the release arch is attached to the first flange;

b. a spindle rotatable about the axis comprising:
   i. a disc with an upper end and a lower end,
   ii. an elevated dial section extending upwardly from the disc upper end, the elevated dial section further comprising an outer upper shoulder shelf, and a plurality of slots, disposed into the elevated dial section, wherein the slots are capable of receiving a loop of the headphone cable;
   iii. a hollow cylindrical member extending downwardly from the disc lower end and having an outer circumferential surface and an inner circumferential surface, the cylindrical member further comprising a plurality of cog teeth disposed about the outer circumferential surface of the cylindrical member, the hollow cylindrical member being positioned inside the ring to create a gap between the base plate ring and the cog teeth, wherein the hollow cylindrical member inner circumferential surface further comprises a spring catch for receiving an outside end of a tensioning spring;

c. at least two cover plates with top portions and bottom portions, wherein the two cover plates each include a primary side and a secondary side, wherein bottom portions of the secondary sides of the cover plates are extended with flanges, wherein the flanges of the two cover plates and the flanges of the base plate are conjoined together;

d. wherein the primary side of the cover plates are located proximate to the elevated slot containing surface to provide a horizontal stabilizing force;

e. wherein the bottom portions the cover plates are located proximate to the dial shelf to provide a lateral stabilizing force to the dial shelf;

f. a coilable tensioning spring having an inside end connected to the pivot nub slot, and an outside end connected to the spring catch, wherein the spring is movable in a first direction to pretension the spring, and in a second direction opposite the first; and g. a lever comprising a first end and a second end, wherein the first end is placed within the anchor bay of the base plate and the second end extends outwardly through the release slot of the base plate, and an engagement point cable of engaging with the cog teeth when the spring is pre-tensioned to maintain the pre-tensioned force on the spring, and capable of disengaging from the cog teeth to release the spring.

2. The headphone reel of claim 1, wherein the primary side of the cover plates are saddle shaped, wherein the primary sides cover plates.

3. The headphone reel of claim 1, wherein the cover plates further comprise slips for receiving the earbuds of the headphone.

4. A method to operate a spring loaded headphone reel, the method comprising:

a. winding a spindle in a first direction to develop a pre-tensioning of the spring;

b. placing a headphone cable in the slots located on a top surface of the spindle;

c. pressing a lever to release a force of the pre-tensioned spring which in turn rotates the spindle in a second direction opposite the first direction;

d. allowing the headphone cable to wrap and store around a dial during the rotation of the spindle in the second direction;

e. pulling the headphone cable from the dial as when and required by the user for next use, which in turn again causes the spindle to rotate in the first direction to again pretension the spring; and f. after the headphone cable is removed, rotating the spindle, as may be required, in the first direction to further pretension the spring for next use.

5. A detachable spring loaded headphone reel for storing and protecting a headphone cable comprising:

a. a base member, oriented in a first plane, having an outside surface, an inside surface, an outer peripheral edge defining base left, right, front and back edges, a peripheral retaining wall extending upwardly from the inside surface along the outer peripheral edge, and a pawl lever release slot through a portion of the retaining wall proximate the left front peripheral edge;

b. a base midpoint centrally located in the inside surface of the base;

c. an axis of rotation emanating from the base midpoint substantially perpendicularly to the base first plane;

d. a cylindrical spring mounting pivot nub for securing a first, internal end of a coilable spring, the pivot nub being attached to the base inside surface and coaxially aligned with the axis of rotation;

e. a semi-circular ring wall attached to the base and centered about the axis of rotation, the ring wall having a semi-circumference defined at a first radial distance from the axis of rotation, the ring wall semi-circumference further defining an opening in the ring wall facing the left edge of the base;

f. a convex shaped camming surface extending inwardly from the left edge of the base along the base inside surface, the camming surface generally facing the ring wall opening, but ending at a distance from the ring wall to form a pawl lever gap between the camming surface and the ring wall, the pawl lever gap having a first end at the pawl lever release slot, and an opposite end defining a pawl anchor bay space between the camming surface, the ring wall and the back right edge of the retaining wall;

g. a pawl lever located within the pawl lever retaining space, the lever further comprising an enlarged first end capable of securely fitting within the pawl anchor bay, a second end extending out of the front retaining wall of the base through the pawl release slot, and a central pawl section between the first and second ends, the central pawl section further comprising a pointed member extending inwardly through the ring wall opening and capable of engaging with or disengaging from a ratchet gear, the pawl lever second end capable of urging the pawl lever to move from a first position where the pawl pointed member is engaged with a ratchet gear, to a second position where the pawl pointed member is disengaged from a ratchet gear, the camming action urging the lever towards the first, engaged position;

h. a coilable spring having a first internal end and a second external end, the spring being coaxially mounted about the axis of rotation, the first internal spring end being attached to the pivot nub;

i. opposed flange members extending upwardly from the left and right outer peripheral edges of the base to a desired flange height;

j. a spindle, rotatable about the axis between the opposed flange members, the spindle comprising:

i. a central disc section having upper and lower surfaces and an outer circumferential edge located at a second radial distance from the axis greater than the ring wall radial distance;

ii. a generally cylindrical dial oriented about the axis and extending upwardly from the disc upper surface, the dial having an outer circumferential surface disposed a distance inwardly from the disc outer circumferential edge, the outer dial surface having a lower end connected to the disk and an upper end, the dial further comprising a circumferential shoulder extending radially inwardly from the outer dial surface upper end to an inner shoulder circumferential intersection, the dial further comprising an additional raised section, extending upwardly from the inner shoulder intersection and defining a raised section outer circumferential surface;

iii. two adjacent slots extending into and across the raised dial section, the slots capable of receiving a headphone cable;

iv. a hollow cylindrical ratchet gear member having inner and outer surfaces extending downwardly from the lower disc surface, the ratchet gear defining a circumference disposed at radial a distance from the axis that is less than the ring wall radius, the ratchet gear further comprising a plurality of teeth disposed about the outer surface of the ratchet gear member, the teeth capable of locking with the pawl point member when a rotational force about the axis is applied in a first direction to the spindle, the teeth not locking with the pawl point with a rotational force about the axis is applied in a second direction, opposite the first direction, to the spindle, the ratchet gear member inner surface further comprising a spring catch extending therefrom forming a spring catch groove for receiving the spring second external end; and k. opposed cover plates having outer and inner ends, the outer ends being attached to the flanges, the cover plates extending radially inwardly to a distance proximate the outer circumferential surface of the dial raised section, the cover plates having upper and lower surfaces, the lower surfaces proximate the inner ends being spaced apart from the dial should to form a spindle retaining area gap, the cover plate inner ends being generally convex in shape.

* * * * *